US005331866A

United States Patent [19]

Voight et al.

[11] Patent Number: 5,331,866

[45] Date of Patent: Jul. 26, 1994

[54] CAMSHAFT ARRANGEMENT HAVING A DEACTIVATABLE CAM

[75] Inventors: Dieter Voight; Horst-Günter Hilderts, both of Wolfsburg, Fed. Rep. of Germany

[73] Assignee: Volkswagen AG, Wolfsburg, Fed. Rep. of Germany

[21] Appl. No.: 54,894

[22] Filed: Apr. 28, 1993

Related U.S. Application Data

[63] Continuation-in-part of Ser. No. 896,625, Jun. 10, 1992, Pat. No. 5,239,885.

[30] Foreign Application Priority Data

May 9, 1992 [DE] Fed. Rep. of Germany ..... 4215298

[51] Int. Cl.[5] ..... F01L 1/04; F16H 53/00

[52] U.S. Cl. ..... 74/567; 123/90.17; 123/90.32; 123/198 F

[58] Field of Search ..... 74/567, 568 R, 838; 123/90.17, 90.32, 90.6, 198 F; 192/85 AT

[56] References Cited

U.S. PATENT DOCUMENTS

| | | | |
|---|---|---|---|
| 4,404,937 | 9/1983 | Leitermann | 123/198 F |
| 4,788,946 | 12/1988 | Inoue et al. | 123/90.6 X |
| 4,844,022 | 7/1989 | Konno | 123/90.6 X |
| 4,887,563 | 12/1989 | Ishida et al. | 123/90.17 X |
| 5,099,806 | 3/1992 | Murata et al. | 123/198 F X |
| 5,239,885 | 8/1993 | Voight | 74/567 |

FOREIGN PATENT DOCUMENTS

| | | | |
|---|---|---|---|
| 0160014 | 9/1984 | Japan | 123/198 F |
| 0162307 | 9/1984 | Japan | 123/198 F |

*Primary Examiner*—Rodney H. Bonck
*Attorney, Agent, or Firm*—Brumbaugh, Graves, Donohue & Raymond

[57] ABSTRACT

A camshaft has a deactivatable cam which is selectively couplable to or releasable from the camshaft by a coupling pin which is transversely displaceable in a recess in the camshaft. To move the coupling pin between its connecting position, in which it engages a coupling recess in the cam, and its release position, in which it is retracted within the confines of the camshaft, the face of the coupling pin opposite the coupling recess forms a pressure chamber in which variable pressure is controlled by a displaceable control piston. A high pressure is applied to move the coupling pin into its connecting position and a lower pressure is applied to maintain the coupling pin in the connecting position, while a further reduced pressure is applied to retract the coupling pin into its release position.

8 Claims, 2 Drawing Sheets

CAMSHAFT ARRANGEMENT HAVING A DEACTIVATABLE CAM

REFERENCE TO RELATED APPLICATION

This application is a continuation-in-part of the copending Voigt U.S. application Ser. No. 07/896,625, filed Jun. 10, 1992, and now U.S. Pat. No. 5,239,885. The disclosure of that application is incorporated by reference herein.

BACKGROUND OF THE INVENTION

This invention relates to camshaft arrangements having a cam which can be hydraulically coupled to a camshaft.

Camshaft arrangements with deactivatable cams provide a number of advantages since they permit inlet or outlet valves to be rendered active or inactive according to the prevailing operating conditions of an engine by activation or deactivation of the associated cams. Thus, in engines having two intake valves for each cylinder with cams providing different valve opening times, it may be expedient to have both intake valves activated only at higher engine speeds, whereas, at lower engine speeds, one of the two valves is kept closed while the other valve is actuated in the usual manner by an associated cam which has a configuration optimized for low engine speed. Such a camshaft arrangement may also be used in internal combustion engines with a cylinder cut-out arrangement. In such engines, all inlet valves for one or more combustion chambers are kept closed in an economy mode selectable by the operator, for example, in which their associated cams are deactivated. In this condition, the engine will operate at partial load on only some of its cylinders.

Camshaft arrangements having at least one deactivatable cam are disclosed, for example, in German Offenlegungsschrift No. 39 20 938. These conventional designs operate with sleeves which are components of jaw couplings individual to certain cams and are axially slidable on the camshaft in response to pressure applied by a hydraulic medium. When the jaw couplings for a cam are moved into engagement by axial motion of the corresponding sleeve, there is a rotationally fixed connection between the cam, which is otherwise deactivated, and the camshaft. Such a camshaft arrangement may be provided if there is room enough in the axial direction of the camshaft to accommodate the displaceable coupling components for each of the deactivatable cams.

The copending Voigt U.S. application Ser. No. 07/896,625, filed Jun. 10, 1992, of which this application is a continuation-in-part, discloses a camshaft arrangement having at least one deactivatable cam mounted on a camshaft with a coupling which includes a coupling pin displaceable in a transverse, approximately radial recess in the camshaft between an engaged position, in which it engages an inner coupling recess in the cam to establish a rotationally fixed connection between the cam and the camshaft, and a release position, in which it is withdrawn from the coupling recess to disconnect the cam from the camshaft. The end of the coupling pin opposite from the coupling recess, i.e., the rear face, together with the recess in the camshaft, forms a pressure chamber which communicates with a supply of hydraulic fluid within the camshaft, and the coupling recess in the cam has an associated pressure relief such as an opening to atmospheric pressure. Such a camshaft having coupling pins which are displaceable at least approximately radially has the advantage of a short structural length while providing for deactivatability of at least one cam.

Because of the high rotational speeds of camshafts in internal combustion engines, such as those for motor vehicles, and the corresponding centrifugal forces, however, difficulties may be encountered in assuring precisely timed motion of the coupling pin between its two positions in such deactivatable cam arrangements.

SUMMARY OF THE INVENTION

Accordingly, it is an object of the present invention to provide a camshaft arrangement having at least one deactivatable cam which overcomes the disadvantages of the prior art.

Another object of the invention is to provide a camshaft arrangement having a deactivatable cam in which the camshaft is essentially unchanged in length by the provision for selective activation or deactivation of certain cams while, at the same time, very reliably providing a precisely timed actuation of the coupling between the camshaft and a deactivatable cam.

These and other objects of the invention are attained by providing a camshaft arrangement having a transversely displaceable pin for coupling and uncoupling a cam to a camshaft in which a camshaft recess which receives the cam provides a pressure chamber to which a pressure medium may be supplied or withdrawn by operation of a control piston in a compression chamber for the pressure medium.

Thus, by axial motion of the control piston, which may be controlled externally, an elevated pressure is produced in the compression chamber relative to the pressure in an external hydraulic system to which it is connected, for example the lubricating oil system of an internal combustion engine. The elevated pressure is transmitted by the pressure medium to the pressure chamber in the camshaft recess by way of connecting passages, preferably within the coupling pin, and it forces the coupling pin quickly out of its release position and into its coupling position in which it locks the deactivatable cam to the camshaft. After the control piston has moved completely into the compression chamber, flow communication is established between the compression chamber and a passage to the external hydraulic system so that a corresponding pressure reduction then occurs in the pressure chamber. The pressure of the medium in that chamber is thus reduced to a holding level. This constitutes a preparation for a return motion of the coupling pin into its release position to again deactivate the cam. In order to initiate this return motion, the control piston is axially retracted in the compression chamber. This motion first breaks the connection between the compression chamber and the external hydraulic system and then generates a negative pressure in the compression chamber by enlarging its volume, and the correspondingly reduced pressure is transmitted to the pressure chamber to cause the coupling pin to be retracted from the coupling recess in the cam. This return motion of the control piston may be assisted by a restoring spring.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
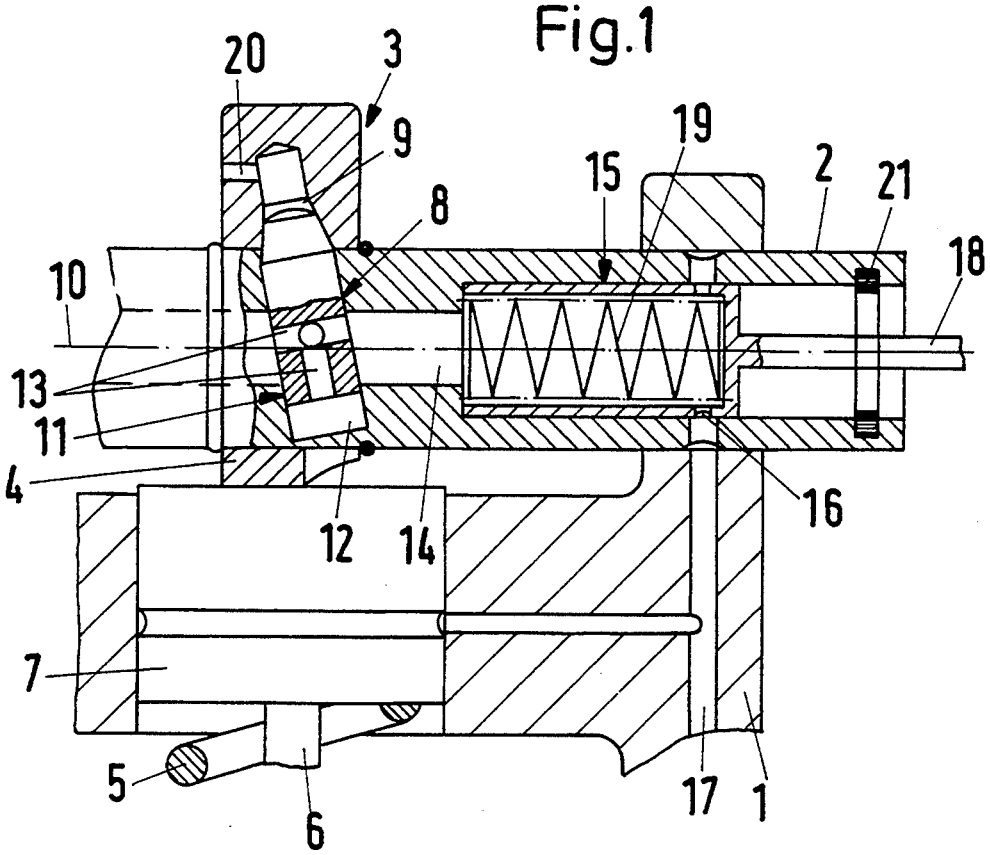
FIG. 1 is a longitudinal sectional view showing a representative embodiment of a camshaft arrangement according to the invention with a deactivatable cam in the coupling position.
Figure 2:
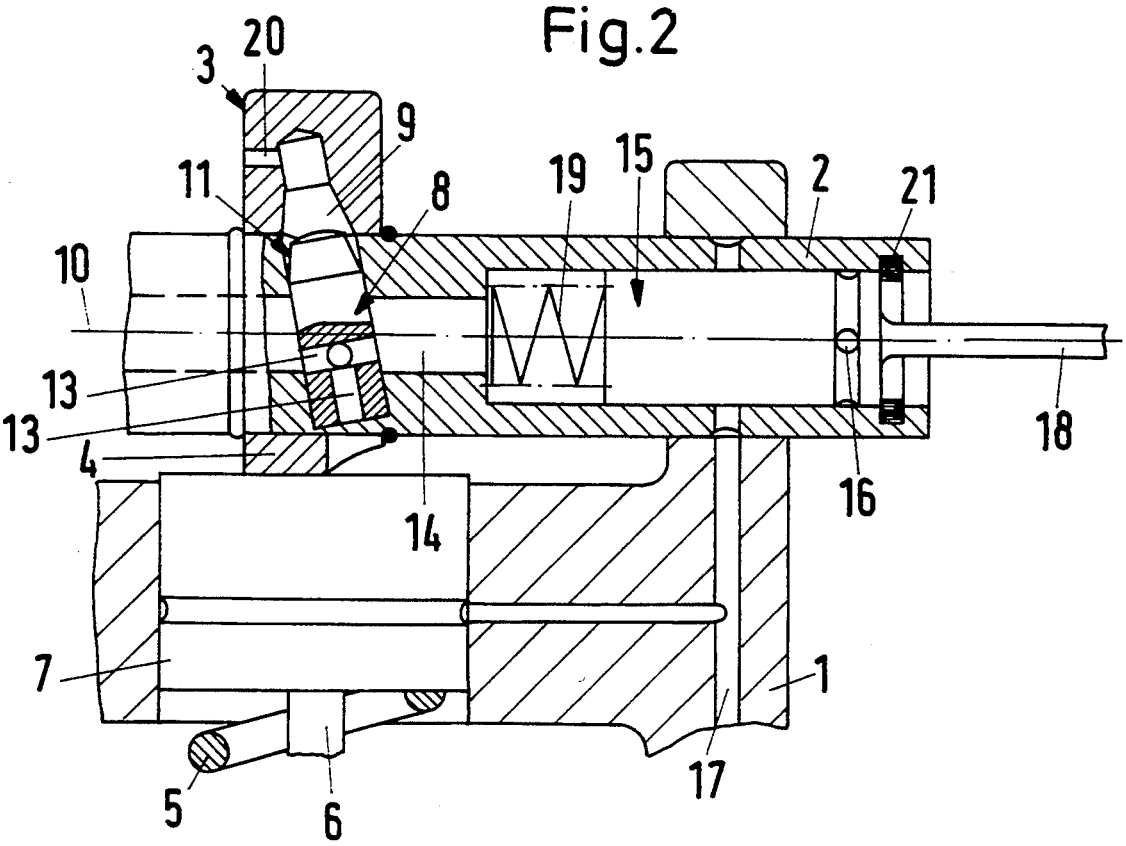
FIG. 2 is a longitudinal sectional view of the embodiment shown in FIG. 1 with the deactivatable cam in the release position.

In the typical embodiment of the invention shown in FIGS. 1 and 2, a cyclinder head 1 of an internal combustion engine has a camshaft 2, supported for rotation in the usual manner and carrying several cams, only one of which, a deactivatable cam 3 having a base circle region 4, is shown in the drawings. The cam 3 is arranged to actuate a lift valve 6, such as an intake valve of the engine which is provided with a closing spring 5, by way of the tappet plunger 7. The tappet plunger, which is of conventional design and requires no descripton, is mounted in the cylinder head 1 for reciprocating motion in the direction of the valve axis.

The cam 3 is connectable to the camshaft 2 by way of a disconnectable coupling to be hereinafter described in such manner that it will be connected to the camshaft 2 so as to periodically open the valve associated with it only at high engine speed. As a result, a large cross-sectional intake area formed by the valve 6 together with another valve (not shown), which is permanently actuated, will be provided only at high speeds to supply intake gases to the corresponding combustion chamber.

The coupling between the camshaft 2 and the cam 3 is formed by a coupling pin 8 which is displaceable in a transverse recess 11 of the camshaft 2 between a coupling position, shown in FIG. 1, in which it engages an inner coupling recess 9 in the cam 3, and a retracted release position, shown in FIG. 2, in which it is withdrawn from the coupling recess 9 in the cam to disconnect the cam 3 from the camshaft 2.

To take into account centrifugal forces, it may be desirable to design the mass distribution of the coupling pin 8 so that its center of mass in the release position shown in FIG. 2 is between the axis 10 of the camshaft and the bottom of the transverse recess 11, which in the illustrated embodiment is slightly inclined from a radial orientation. This slightly oblique arrangement of the transverse recess 11 is advantageous for reasons of manufacture since a slight reduction in the width of the cam 3 at its base circle region 4 will permit access by a recess-forming tool.

In order to shift the coupling pin 8 between its two extreme positions, a hydraulic system is provided. This system includes a pressure chamber 12 formed in the transverse recess 11, two passages 13 in the coupling pin 8, a hydraulic fluid passage 14 in the camshaft 2, and a cup-shaped control piston 15, which is axially slidable in the camshaft and is formed with a through-flow passage 16. The passage 16 intersects the end of a passage 17 in the cylinder head 1 which is connected to an external hydraulic system, for example, the lubricating oil system of the engine, only when the control piston 15 is in the position shown in FIG. 1. In that position, the passage 16 establishes communication between the passage 17 leading to the external hydraulic system and a compression chamber of variable volume formed by the interior of the control piston 15 as well as with the region of the pressure medium supply passage 14 located to the left of the piston 15 as seen in FIG. 1 and, through that passage, with the connecting passages 13 and the pressure chamber 12. In FIG. 1, showing the cam 3 in the activated position, a force has been applied to a plunger 18 to move it and the piston 15 axially to the left as seen in the drawings against the force of a restoring spring 19 within the piston and against the hydraulic pressure in the compression chamber until it reaches a stop, thereby reducing the volume of the compression chamber and elevating the pressure therein. The resulting pressure increase in the pressure chamber 12 has driven the coupling pin 8 upwardly into its coupling position as shown in FIG. 1. The through-flow aperture 16 in the piston 15 comes into alignment with the passage 17 only at the end of the motion of the piston to the left as seen in FIG. 1 so that the high pressure in the pressure chamber 12 is then relieved by the pressure equalization. As a result, there is a change from the high pressure required to force the coupling pin 8 quickly into the coupling position to a lower pressure which is sufficient to hold the coupling pin 8 securely in the coupling recess 9, which is vented to atmospheric pressure by way of an orifice 20.

When the coupling pin 8 is to be retracted into its release position shown in FIG. 2, a force directed to the right as seen in the figures is applied to the plunger 18 to move the control piston 15 to the right as seen in FIG. 2 as far as a stop 21. By this motion, after communication between the flow aperture 16 and the passage 17 is discontinued, a negative pressure will be produced in the space containing the pressure chamber 12. This rapidly retracts the coupling pin 8 into its release position shown in FIG. 2. Preferably, the mass distribution of the coupling pin 8 is designed so that the center of mass in the release position is between the camshaft axis 10 and the pressure chamber 12, which has essentially disappeared in FIG. 2

Figure 3:
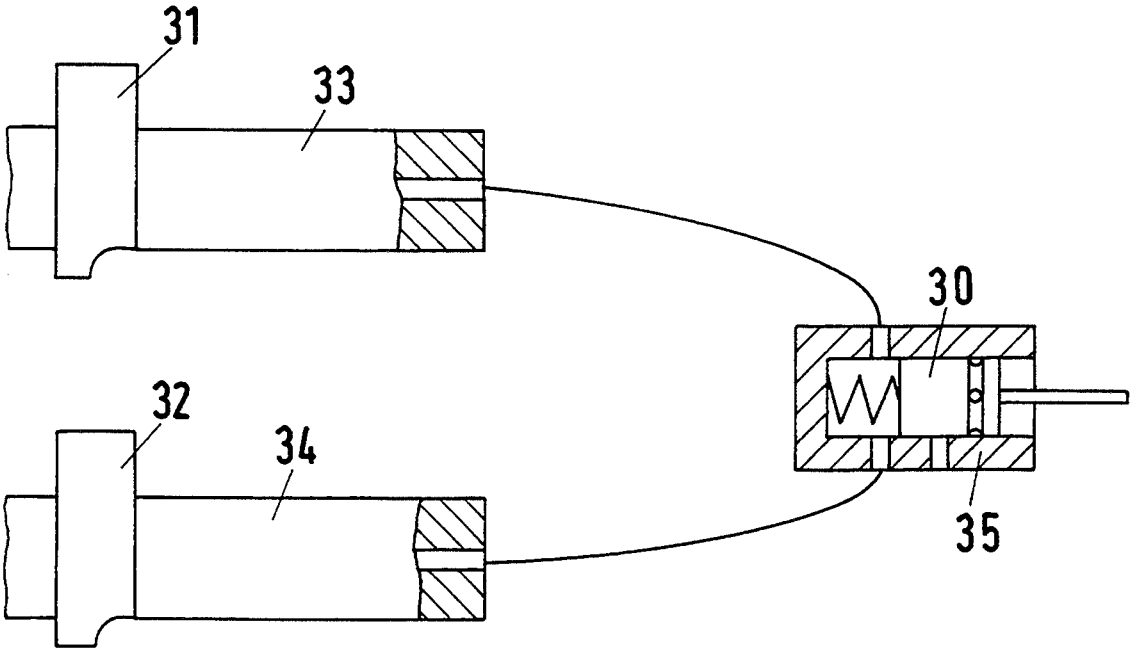
FIG. 3 is a view, partly sectional, of another embodiment.

FIG. 3 shows an embodiment of the invention in which the control piston 30 controls the pressure of hydraulic fluid for deactivatable cams 31 and 32 disposed on different camshafts 33 and 34. The control piston 30 now is arranged outside of the camshafts 33 and 34 in a separate housing 35.

Of course, the couplings for the cams 31 and 32 and the function of the control piston 30 are the same as described with reference to FIG. 1 and 2.

Thus, with a comparatively simple structure, the invention provides a camshaft arrangement with a deactivatable cam of compact configuration while permitting preciseley timed, dependable operation of the deactivatable cam.

Although the invention has been described herein with reference to specific embodiments, many modifications and variations therein will readily occur to those skilled in the art. Accordingly, all such variations and modifications are included within the intended scope of the invention.

We claim:

1. A camshaft arrangement having at least one deactivatable cam comprising a camshaft, a cam rotatably supported on the camshaft and having a coupling recess facing the camshaft with a pressure relief opening, a hydraulically actuatable coupling for selective establishment of a rotationally fixed connection between the cam and the camshaft including a transverse recess in the camshaft, a coupling pin displaceable in the transverse recess between a coupling position in which it engages the coupling recess in the cam to establish the rotationally fixed connection with the cam and a release position in which it is retracted from the coupling recess to disconnect the rotationally fixed connection, the coupling pin having a surface facing the bottom of the camshaft transverse recess which, together with the camshaft transverse recess, forms a pressure chamber, connecting passage means to supply hydraulic fluid to the pressure chamber, an axially displaceable control piston forming a variable-volume compression chamber communicating with the connecting passage means to control the pressure in the pressure chamber, and pressure relief passage means for relieving the hydraulic pressure in the compression chamber when the control piston has moved to a position reducing the volume of the compression chamber.

2. A camshaft arrangement according to claim 1 wherein the connecting passage means includes a passage formed in the coupling pin.

3. A camshaft arrangement according to claim 1 wherein the control piston is in the shape of a hollow cylinder which is closed at one end and is open in the direction toward the coupling pin and which has a flow aperture communicating with the pressure relief passage only when the control piston has moved to the position reducing the chamber volume.

4. A camshaft arrangement according to claim 3 including a restoring spring disposed within the hollow-cylinder control piston.

5. A camshaft arrangement according to claim 1 wherein the coupling pin has a center of mass which, at least in its release position, is disposed between the axis of the camshaft and the pressure chamber.

6. A camshaft arrangement according to claim 1 wherein the control piston is mounted in the camshaft for axial motion therein.

7. A camshaft arrangement according to claim 1 wherein the control piston is disposed outside of the camshaft.

8. A camshaft arrangement according to claim 7 wherein the control piston controls the pressure of hydraulic fluid for deactivatable cams disposed in a plurality of associated camshafts.

* * * * *